US010532859B1

(12) United States Patent
Rothrock, Jr. et al.

(10) Patent No.: US 10,532,859 B1
(45) Date of Patent: Jan. 14, 2020

(54) INVERTIBLE CONTAINER FOR DISPLAY AND DISPENSING OF PRODUCT

(71) Applicant: CMG Partners, Inc., San Jose, CA (US)

(72) Inventors: Sarah Rose Rothrock, Jr., San Francisco, CA (US); Marcus LeJay, Los Angeles, CA (US); Tracy Liang Ogishi, Redwood City, CA (US); Dennis Robert O'Malley, San Carlos, CA (US); Adrian X. Trejo, Santa Clara, CA (US)

(73) Assignee: CMG PARTNERS, INC., San Jose, CA (US)

( * ) Notice: Subject to any disclaimer, the term of this patent is extended or adjusted under 35 U.S.C. 154(b) by 0 days.

(21) Appl. No.: 16/183,518

(22) Filed: Nov. 7, 2018

Related U.S. Application Data

(60) Provisional application No. 62/734,234, filed on Sep. 20, 2018.

(51) Int. Cl.
*B65D 41/06* (2006.01)

(52) U.S. Cl.
CPC ..... *B65D 41/06* (2013.01); *B65D 2215/00* (2013.01); *B65D 2251/065* (2013.01)

(58) Field of Classification Search
CPC ..... B65D 41/06; B65D 2251/065; B65D 2215/00
USPC ..... 220/293, 304, 789–791, 801–803; 215/320
See application file for complete search history.

(56) References Cited

U.S. PATENT DOCUMENTS

| | | | | |
|---|---|---|---|---|
| 855,917 | A * | 6/1907 | Westlake | B65D 41/185 215/320 |
| 3,311,250 | A * | 3/1967 | Lodding | B65D 1/0246 215/340 |
| 3,459,320 | A * | 8/1969 | Itoh | B65D 41/185 215/295 |
| 3,898,046 | A | 8/1975 | Ikeda et al. | |
| 4,387,820 | A * | 6/1983 | Ignell | B65D 41/225 215/320 |
| 4,591,063 | A * | 5/1986 | Geiger | B65D 41/0478 215/330 |
| 8,091,724 | B2 | 1/2012 | King | |
| 2005/0051508 | A1* | 3/2005 | Hackmann | B65D 41/0414 215/343 |
| 2017/0001763 | A1* | 1/2017 | Hu | B65D 41/045 |

* cited by examiner

*Primary Examiner* — James N Smalley
(74) *Attorney, Agent, or Firm* — Brian R. Galvin; Vanessa B. Pierce; Galvin Patent Law, LLC

(57) ABSTRACT

An invertible container for display and dispensing of product, that uses a lid with a raised surface or solid plug that aligns with the interior of the container neck, such that when closed the lid forms a flat surface with the interior of the container and no product is permitted to enter the neck of the container where it would be obscured from view.

6 Claims, 3 Drawing Sheets

INVERTIBLE CONTAINER FOR DISPLAY AND DISPENSING OF PRODUCT

CROSS-REFERENCE TO RELATED APPLICATIONS

This application claims priority to U.S. provisional patent application Ser. No. 62/734,234, titled "INVERTIBLE CONTAINER FOR DISPLAY AND DISPENSING OF PRODUCT", which was filed on Sep. 20, 2018, the entire specification of which is incorporated herein by reference.

BACKGROUND

Field of the Art

The disclosure relates to the field of containers, and more particularly to the field of displaying and dispensing small quantities of product.

Discussion of the State of the Art

Containers for storing, displaying, and dispensing product often use a removable lid or cap that affixes to a raised neck portion of the container, threading or locking into place about the neck to close the container. When stood upright, the lid blocks the view of the product in the container. Inverting the container for a better view of the product causes the contained product can sink or fall into the neck portion of the container if it is inverted, causing some of the product within the container to be obscured from view. This can be an issue for containers meant to be used for display, such as to present product on store shelves or to accurately indicate how much product remains within the container.

What is needed is a new design for an invertible container for display and dispensing of product, that uses a lid with a raised surface or solid plug that aligns with the interior of the container neck, such that when closed the lid forms a flat surface with the interior of the container and no product is permitted to enter the neck of the container where it would be obscured from view.

SUMMARY

Accordingly, the inventor has conceived and reduced to practice, a new design for an invertible container for display and dispensing of product, that uses a lid with a raised surface or solid plug that aligns with the interior of the container neck, such that when closed the lid forms a flat surface with the interior of the container and no product is permitted to enter the neck of the container where it would be obscured from view.

According to a preferred embodiment, an invertible container for display and dispensing of product is disclosed, comprising: a hollow body with at least one side made of a transparent material, having an opening at the top, around which opening on the outside of the hollow body is a raised flange containing grooves into which are formed ramps and recessed areas for guiding and holding tabs formed into a lid; and a lid having a protruding portion on the bottom of just less than the interior dimension of the opening in the hollow body, and a depression around the protruding portion into which the flange of the hollow body may be inserted and containing tabs corresponding to the grooves in the flange, and in which depression is a compressible material capable of providing a tight seal between the lid and the hollow body; wherein, when the lid is placed onto the hollow body, the protruding portion on the bottom of the lid fits snugly inside the opening at the top of the hollow body and the flange on the outside of the hollow body fits into the depression around the protruding portion; wherein, when the lid is placed onto the container, the tabs on the lid are forced into recessed areas of the flange against the force of compression of the compressible material between the lid and the flange, or tabs on the flange are forced into recessed areas of the lid, and the lid is held in place by pressure of the tabs against the recessed areas, thus creating both an airtight seal and a child-resistant safety feature; and wherein, when the lid is affixed to the hollow body, the top of the raised portion of the lid sits flush with the interior surface of the hollow body on the side where the lid is attached, such that, when the entire container is inverted and stood on the lid, the container may be used as a display, and any product inside the container is held up inside the hollow body flush with the interior surface of the hollow body.

According to another preferred embodiment, the above-described invertible container is disclosed, wherein: the opening in the top of the body, the flange, the protruding portion of the lid, and the depression in the lid are circular; and when the lid is rotated, the tabs on the lid are forced up the ramps in the grooves of the flange against the force of compression of the compressible material between the lid and the flange, dropped into the recessed areas of the grooves, and held in the recessed areas by the compression of the compressible material between the lid and the flange, thus creating both an airtight seal and a child-resistant safety feature.

According to an aspect of an embodiment, the exterior shape of the base and enclosure together forms a rectangle or cube.

According to an aspect of an embodiment, the exterior shape of the base and enclosure together forms a cylinder.

According to an aspect of an embodiment, the exterior shape of the base and enclosure together forms a regular polygon.

According to an aspect of an embodiment, the top of the lid is rounded and weighted such that, when inverted, the container stands vertically due to the weight of the lid, rather than due to a flat surface on the top of the lid.

BRIEF DESCRIPTION OF THE DRAWING FIGURES

The accompanying drawings illustrate several aspects and, together with the description, serve to explain the principles of the invention according to the aspects. It will be appreciated by one skilled in the art that the particular arrangements illustrated in the drawings are merely exemplary, and are not to be considered as limiting of the scope of the invention or the claims herein in any way.

DETAILED DESCRIPTION

Figure 1:
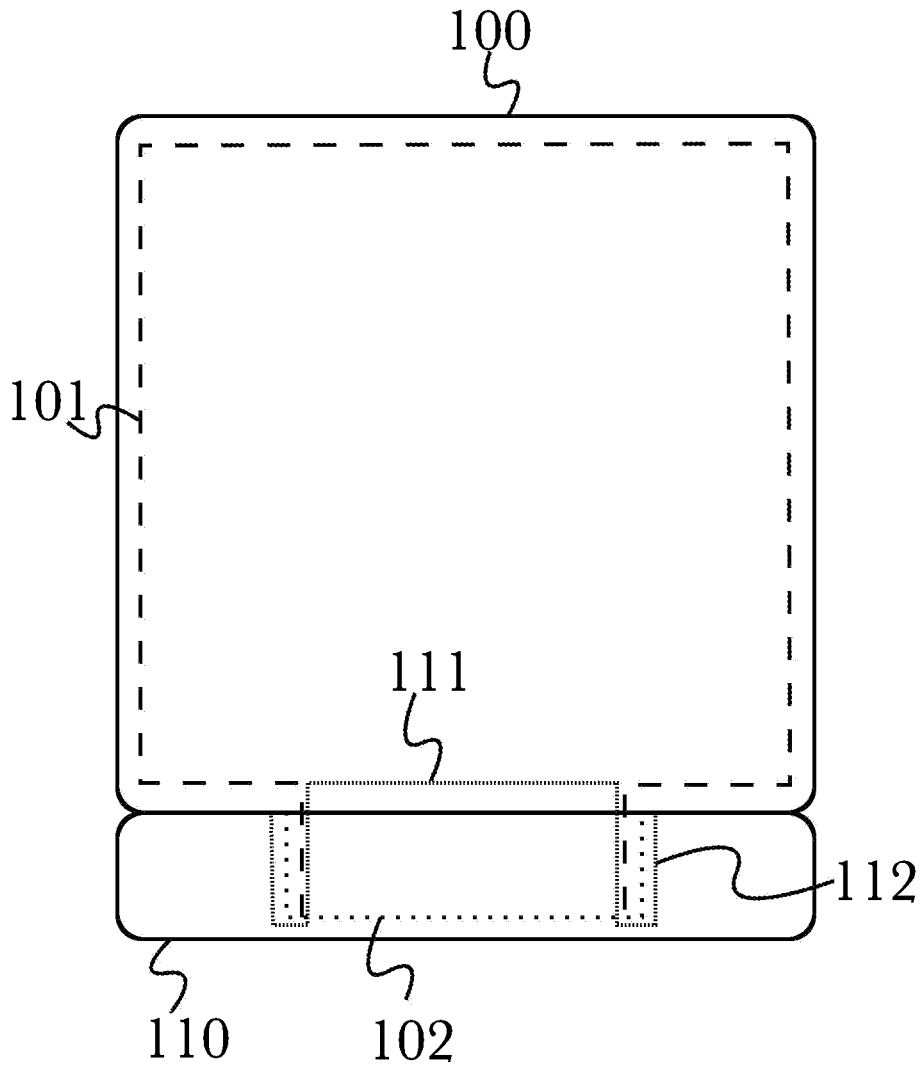
FIG. 1 is a diagram illustrating a side view of an exemplary invertible container for display and dispensing of product, according to a preferred embodiment.

The inventor has conceived, and reduced to practice, a new design for an invertible container for display and dispensing of product, that uses a lid with a raised surface or solid plug that aligns with the interior of the container neck, such that when closed the lid forms a flat surface with the interior of the container and no product is permitted to enter the neck of the container where it would be obscured from view.

One or more different aspects may be described in the present application. Further, for one or more of the aspects described herein, numerous alternative arrangements may be described; it should be appreciated that these are presented for illustrative purposes only and are not limiting of the aspects contained herein or the claims presented herein in any way. One or more of the arrangements may be widely applicable to numerous aspects, as may be readily apparent from the disclosure. In general, arrangements are described in sufficient detail to enable those skilled in the art to practice one or more of the aspects, and it should be appreciated that other arrangements may be utilized and that structural, logical, software, electrical and other changes may be made without departing from the scope of the particular aspects. Particular features of one or more of the aspects described herein may be described with reference to one or more particular aspects or figures that form a part of the present disclosure, and in which are shown, by way of illustration, specific arrangements of one or more of the aspects. It should be appreciated, however, that such features are not limited to usage in the one or more particular aspects or figures with reference to which they are described. The present disclosure is neither a literal description of all arrangements of one or more of the aspects nor a listing of features of one or more of the aspects that must be present in all arrangements.

Headings of sections provided in this patent application and the title of this patent application are for convenience only, and are not to be taken as limiting the disclosure in any way.

A description of an aspect with several components in communication with each other does not imply that all such components are required. To the contrary, a variety of optional components may be described to illustrate a wide variety of possible aspects and in order to more fully illustrate one or more aspects. Similarly, although process steps, method steps, algorithms or the like may be described in a sequential order, such processes, methods and algorithms may generally be configured to work in alternate orders, unless specifically stated to the contrary. In other words, any sequence or order of steps that may be described in this patent application does not, in and of itself, indicate a requirement that the steps be performed in that order. The steps of described processes may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to one or more of the aspects, and does not imply that the illustrated process is preferred. Also, steps are generally described once per aspect, but this does not mean they must occur once, or that they may only occur once each time a process, method, or algorithm is carried out or executed. Some steps may be omitted in some aspects or some occurrences, or some steps may be executed more than once in a given aspect or occurrence.

When a single device or article is described herein, it will be readily apparent that more than one device or article may be used in place of a single device or article. Similarly, where more than one device or article is described herein, it will be readily apparent that a single device or article may be used in place of the more than one device or article.

The functionality or the features of a device may be alternatively embodied by one or more other devices that are not explicitly described as having such functionality or features. Thus, other aspects need not include the device itself.

Techniques and mechanisms described or referenced herein will sometimes be described in singular form for clarity. However, it should be appreciated that particular aspects may include multiple iterations of a technique or multiple instantiations of a mechanism unless noted otherwise. Process descriptions or blocks in figures should be understood as representing modules, segments, or portions of code which include one or more executable instructions for implementing specific logical functions or steps in the process. Alternate implementations are included within the scope of various aspects in which, for example, functions may be executed out of order from that shown or discussed, including substantially concurrently or in reverse order, depending on the functionality involved, as would be understood by those having ordinary skill in the art.

Detailed Description of Exemplary Embodiments and Aspects

FIG. 1 a diagram illustrating a side view of an exemplary invertible container 100 for display and dispensing of product, according to a preferred embodiment. According to the embodiment, an invertible container 100 is shown in an inverted position, with a lid 110 attached to enclose product within a hollow body 101 of the container 100. Also shown is a raised circular flange 102 which forms a neck portion of container 100, onto which lid 110 is fitted and sealed. Lid 110 further comprises a protruding circular portion 111, which forms a flat interior surface 120 with the interior of hollow body 101 when closed, thus preventing any contents of the container 100 from entering the neck portion formed by the raised circular flange 102. Protruding circular portion 111 may also be formed into a recessed circular portion 112 that is configured to enclose and mate with raised circular flange 102, for example using a plurality of tabs 111 that lock into a plurality of formed ramps and recesses 104, as described below in FIG. 3.

Figure 2:
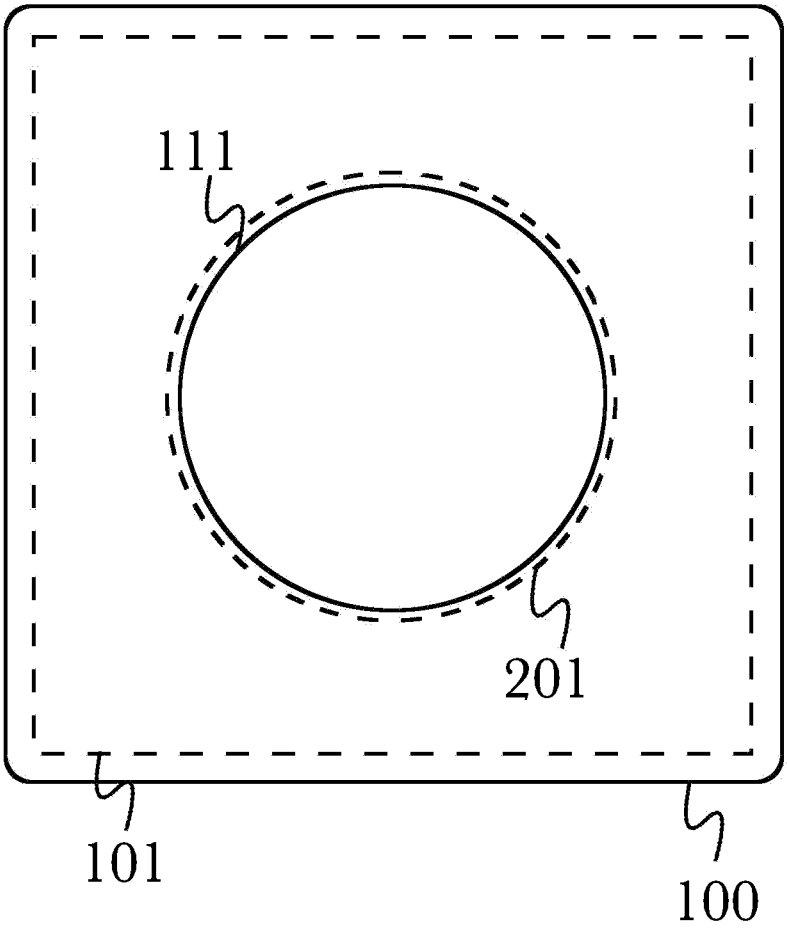
FIG. 2 is a diagram illustrating an end-facing view through an exemplary invertible container for display and dispensing of product, according to a preferred embodiment.

FIG. 2 is a diagram illustrating an end-facing view through an exemplary invertible container 100 for display and dispensing of product, according to a preferred embodiment. According to the embodiment, an invertible container 100 is shown when viewed through a transparent end face opposite lid 110. As shown, hollow body 101 of container 100 comprises a raised circular flange 102 which, when viewed directly on end as illustrated, forms a circular opening 201 into which a protruding circular portion 111 of lid 110 is fitted when closed, thereby sealing the opening 201 formed by raised circular flange 102 to form a flat surface. When sealed in this manner, the interior faces of hollow body 101 each form a flat surface, forming an enclosed container wherein any and all contents may be visible as nothing is permitted to enter the circular opening 201.

Figure 3:
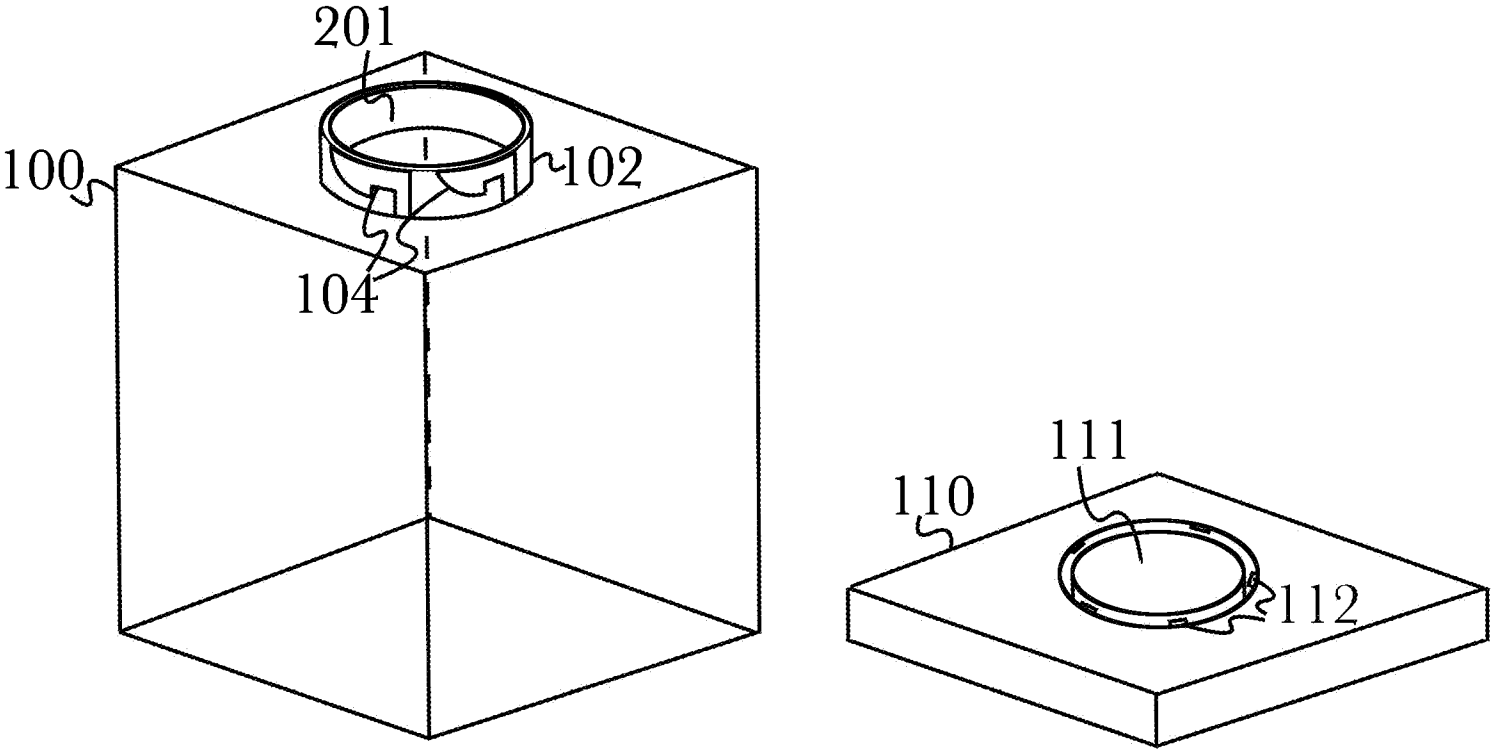
FIG. 3 is a diagram illustrating a perspective view of an exemplary invertible container for display and dispensing of product with lid removed to show circular seal and child-resistant features, according to a preferred embodiment.

FIG. 3 is a diagram illustrating a perspective view of an exemplary invertible container 100 for display and dispensing of product with lid 110 removed to show circular seal and child-resistant features, according to a preferred embodiment. A raised circular flange 102 of container 100 comprises a round opening 103 and is mated with lid 110 using a plurality of formed ramps and recessed areas 104 that are configured to mate with a plurality of tabs 112 on lid 110, forming a locking seal when lid 110 is pressed and rotated onto the raised circular flange 102 of container 100. Assembling lid 110 onto container 100 in this fashion forms a child-resistant closure, sealing any product within container 100 until lid 110 is pressed and rotated to unlock tabs 112 from the formed ramps and recesses 104, allowing lid 110 to be rotated and removed. When closed, a protruding circular portion 111 of lid 110 is pressed into the circular opening 201 of container 100, preventing any contents from entering circular opening 201 and being obstructed from view.

When closing lid 110 onto container 100, force must be applied in the direction of container 100 to press tabs 112 against the plurality of formed ramps and recessed areas 104, enabling tabs 112 to move against forms ramps and recessed areas 104 as lid 100 is rotated. When fully closed, lid 100 is aligned with the body of container 100 such that the corners and edges are aligned, and tabs 112 lock into place in recessed areas 104 to seal lid 100 in place. To open again, force must be reapplied against lid 110 before rotating, such that tabs 112 may be pressed against formed ramps 104 and be rotated out of the recessed into which they are locked. In this manner, a child-resistant seal is formed, discouraging children from tampering with container 100 or accessing any contents. This arrangement also prevents the lid 110 from separating from the body 100 when the container is inverted.

When displaying product, for example on store shelves, container 100 may be inverted so that it rests on the sealed lid 110 with transparent body 101 elevated to present contents for viewing. For example, this inverted arrangement allows the body of container 100 and thus the viewable contents to be raised above any signs, stickers, or shelf hardware that might otherwise obstruct a customer's view. Protruding circular portion 111 of lid 110 forms a flush surface with the interior body 101 of container 100, preventing contents from entering the circular opening 201 of the container neck, where they could be obscured from view. In various arrangements, container 100 may be configured such that, when sealed, the shape of container 100 forms a regular polyhedron enclosing contents within its volume, for example container 100 may be configured as a tetrahedron, cube, icosahedron, or other polyhedral shapes. Container 100 may alternately be formed into an irregular shape, such as a cylinder, prism, or novelty shape (for example, an extrusion of a company logo for advertising purposes), but in each configuration the protruding circular portion 111 of lid 110 forms a flush interior surface within container 100 to prevent contents from entering the neck and being obscured or lost.

In some embodiments, the opening in the body of the container, the flange on the body of the container, the raised portion of the lid, and depression in the lid which accepts the flange may be of some shape other than circular. For example, they may be elliptical, square, hexagonal, octagonal, or a similar shape. The shape need not necessarily be a regular shape, and could take the form of an arbitrary, irregular shape. In such embodiments, a different attachment mechanism could be required to ensure that the lid does not separate from the body when inverted, and to retain the child-proof attachment quality.

In some embodiments, the body of the container may be made of glass, a transparent plastic such as acrylic, or any other suitable transparent or semi-transparent material. The material need not be clear, and may be colored or tinted.

In some embodiments, the body of the container may be made of a combination of materials, such as a metal frame with glass inserts. The frame and inserts need not have a regular or consistent shape. For example, the frame could be rectangular or square, with circular cut-outs for circular glass windows, or with a cut-out in the shape of a leaf with an acrylic pane behind the cut-out or inserted into the cut-out.

The skilled person will be aware of a range of possible modifications of the various aspects described above. Accordingly, the present invention is defined by the claims and their equivalents.

What is claimed is:

1. An invertible container for display and dispensing of product, comprising:

a hollow body with at least one side made of a transparent material, having an opening at the top, around which opening on the outside of the hollow body is a raised flange containing grooves into which are formed ramps and a plurality of recessed areas for guiding and holding a plurality of tabs formed into a lid, the lid having a protruding portion on the bottom of just less than the interior dimension of the opening in the hollow body, and a depression around the protruding portion into which the flange of the hollow body may be inserted and containing the plurality of tabs corresponding to the grooves in the flange, and in which the depression is a compressible material capable of providing a tight seal between the lid and the hollow body;

wherein, when the lid is placed onto the hollow body, the protruding portion on the bottom of the lid fits snugly inside the opening at the top of the hollow body and the flange on the outside of the hollow body fits into the depression around the protruding portion;

wherein, when the lid is placed onto the container, the plurality of tabs on the lid are forced into the plurality of recessed areas of the flange against the force of compression of the compressible material between the lid and the flange, or plurality of tabs on the flange are forced into the plurality of recessed areas of the lid, and the lid is held in place by pressure of the plurality of tabs against the plurality of recessed areas, thus creating both an airtight seal and a child-resistant safety feature; and wherein, when the lid is affixed to the hollow body, the top of the protruding portion of the lid sits flush with the interior surface of the hollow body on the side where the lid is attached, such that, when the entire container is inverted and stood on the lid, the container may be used as a display, and any product inside the container is held up inside the hollow body flush with the interior surface of the hollow body.

2. The container of claim 1, wherein:

the opening in the top of the body, the flange, the protruding portion of the lid, and the depression in the lid are circular; and when the lid is rotated, the plurality of tabs on the lid are forced up the ramps in the grooves of the flange against the force of compression of the compressible material between the lid and the flange, dropped into the plurality of recessed areas of the grooves, and held in the plurality of recessed areas by the compression of the compressible material between the lid and the flange, thus creating both an airtight seal and a child-resistant safety feature.

3. The container of claim 1, wherein the exterior shape of the base and enclosure together forms a rectangle or cube.

4. The container of claim 1, wherein the exterior shape of the base and enclosure together forms a cylinder.

5. The container of claim 1, wherein the exterior shape of the base and enclosure together forms a regular polygon.

6. The container of claim 1, wherein the top of the lid is rounded and weighted such that, when inverted, the container stands vertically due to the weight of the lid, rather than due to a flat surface on the top of the lid.

* * * * *